US006499899B2

(12) United States Patent
Sawyer

(10) Patent No.: US 6,499,899 B2
(45) Date of Patent: Dec. 31, 2002

(54) CARPENTER'S PENCIL RETRACTING DEVICE

(76) Inventor: Dennis Sawyer, 8040 Ravine, Westland, MI (US) 48185

( * ) Notice: Subject to any disclaimer, the term of this patent is extended or adjusted under 35 U.S.C. 154(b) by 0 days.

(21) Appl. No.: 09/899,389

(22) Filed: Jul. 5, 2001

(65) Prior Publication Data

US 2002/0005163 A1 Jan. 17, 2002

Related U.S. Application Data

(60) Provisional application No. 60/216,168, filed on Jul. 6, 2000.

(51) Int. Cl.[7] ..... B43K 23/02

(52) U.S. Cl. ..... 401/131; 401/48; 24/10 R; 24/114 C

(58) Field of Search ..... 401/131, 195, 401/52, 48; 24/10 R, 11 R, 11 FE, 11 F, 11 HC; 224/254, 269

(56) References Cited

U.S. PATENT DOCUMENTS

| | | | | | |
|---|---|---|---|---|---|
| 264,593 | A | * | 9/1882 | Wright | 401/131 |
| 1,134,691 | A | * | 4/1915 | Martin et al. | 401/131 |
| 1,506,207 | A | * | 8/1924 | Wahl | 401/131 |
| 2,285,000 | A | * | 6/1942 | Wallace | 401/131 |
| 5,358,348 | A | * | 10/1994 | Kennedy | 401/131 |
| 5,947,623 | A | * | 9/1999 | Smith | 401/131 |

* cited by examiner

*Primary Examiner*—David J. Walczak
(74) *Attorney, Agent, or Firm*—Charles W. Chandler

(57) ABSTRACT

A belt held retractor has a wire connected to a tubing that holds a carpenter's pencil.

16 Claims, 1 Drawing Sheet

CARPENTER'S PENCIL RETRACTING DEVICE

This application claims the benefit of Provisional Application No. 60/216,168 filed Jul. 6, 2000.

BACKGROUND AND SUMMARY OF THE INVENTION

Carpenters and other skilled tradesmen frequently use a pencil to mark their work. In many cases, the user is on a scaffold, a ladder, or an elevated structure. There is a tendency to occasionally drop the pencil. Consequently, carpenters usually carry several pencils. It is inconvenient and costly to lose these special pencils.

The broad purpose of the present invention is to provide a retractable device for retaining a carpenter's pencil or other writing instrument so that if the pencil is accidentally released, it does not drop to the ground. In the preferred embodiment of the invention, the carpenter uses a conventional, retractable reel such as is commonly used for keys and the like. The reel has a housing with a retainer that is clipped onto the user's belt. It has a retractable spring attached to a key ring.

The carpenter's pencil is connected to the key ring in one embodiment, by a relatively stiff expandable section of tubing. The tubing has a diameter less than that of a pencil. The user inserts the pencil into the tubing, expanding the tubing to form a tight frictional engagement with the pencil end. The other end of the tubing has a plug with a hole for receiving the key ring. The arrangement is such that if the carpenter should release the pencil, it is returned to the reel.

In another embodiment of the invention, the pencil is inserted in one end of the tubing to form a tight frictional engagement between the pencil and the tubing. The sides of the other end of the tubing are pressed together and formed with a hole, reinforced with the grommets, that forms an opening for the key ring.

In still another embodiment of the invention, when the user is employing a writing instrument other than the carpenter's pencil, a section of tubing is employed that forms a frictional engagement with the end of the writing instrument. The other end of the tubing has a plug for receiving the key ring.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views; and in which.

DESCRIPTION OF THE PREFERRED EMBODIMENT

Figure 1:
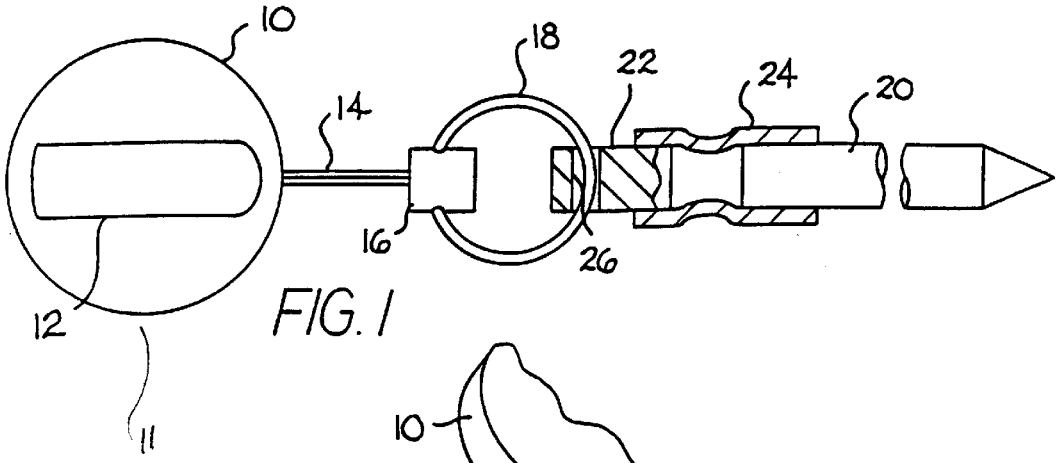
FIG. 1 is a partially sectional view illustrating the preferred embodiment of the invention.
Figure 2:
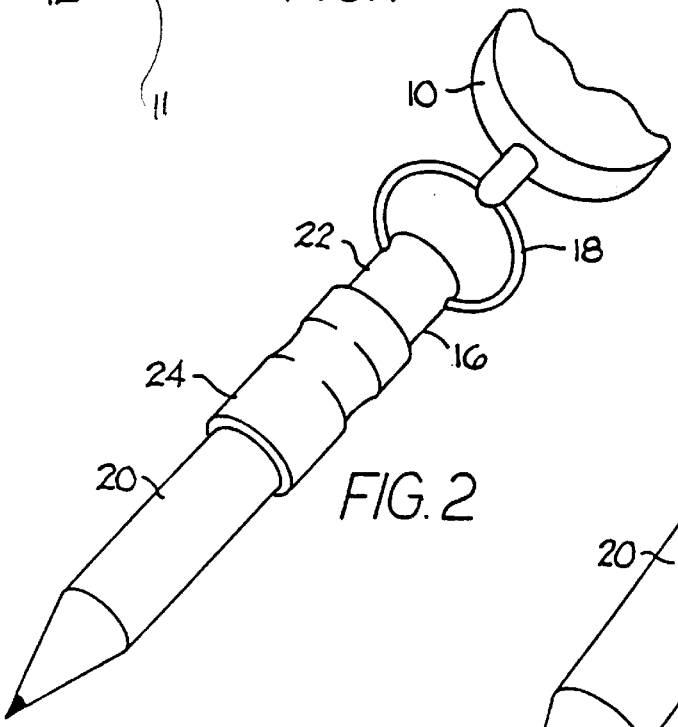
FIG. 2 is a perspective view of the preferred pencil and retainer.

Referring to the drawings, a conventional reel type retractor 10 having a housing 11 has a belt clip 12 (retaining device) for mounting on the user's belt. Retractor 10 is a flexible member holding device. The retractor has an internal retractable reel connected to a wire 14 that can be extended two to three feet from the reel. A perforated metal plug 16 is carried on the wire end.

A key ring 18 is carried in plug 16, and has any suitable diameter such as one inch.

A conventional flat carpenter's pencil 20 is typically about seven inches s long, with an elongated cross section. A plug 22 and a plastic tube 24 (holder) connect the pencil to the key ring. Plug 22, for illustrative purposes, has a onehalf inch diameter and is about seven-eighths inches long, preferably made of plastic with a bore 26. Bore 26 has a sufficient diameter to receive key ring 18. Tube 24 is relatively stiff, but slightly stretchable or resilient with an internal diameter slightly smaller than the diameter of the pencil. The relationship is such that by inserting the end of pencil 20 into the end of the tube, the tube is stretched to form a tight frictional grip on the pencil. The grip is such that the user can pull the pencil from the tube to replace the pencil. However, the grip is sufficient so that the pencil cannot be removed from the tube without a substantial removal force being applied to the pencil.

Similarly, plug 22 also has a diameter slightly greater than the internal diameter of the tube, so that when the plug is placed into the tube, it expands the tube to form a tight grip on the plug. Thus, the pencil may be removed from the tube, however, in use, the pencil is securely connected to wire 14 so that when the pencil is released, the retractor pulls the pencil up to a position adjacent the retractor housing.

Figure 3:
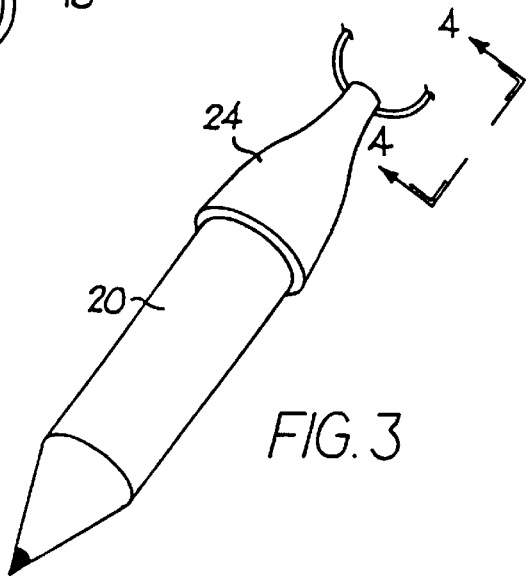
FIG. 3 illustrates another embodiment of the invention.
Figure 4:
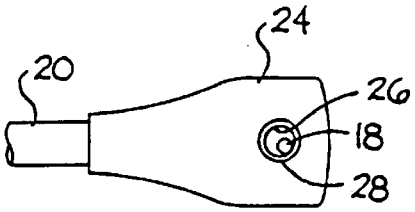
FIG. 4 is a view as seen along lines 4—4 of FIG. 3.

FIG. 3 illustrates another embodiment of the invention. In this case, tube 24 has one end receiving the end of the pencil as described with reference to the embodiment of FIG. 1. However, instead of employing plug 22, the sides of the tube opposite the pencil are squeezed together and formed with a pair of aligned openings 26. Preferably, grommet means 28 are mounted around the openings, for receiving key ring 18. This embodiment is somewhat simpler than the embodiment of FIG. 1 because it eliminates the need for plug 22.

Figure 5:
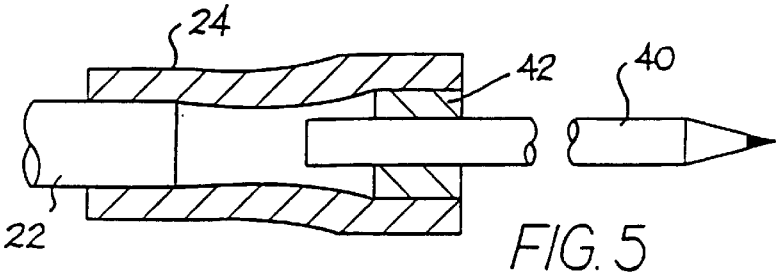
FIG. 5 illustrates an adapter for a round as opposed to a flat pencil.

In some cases, a different type of writing instrument may be used. Referring to FIG. 5, a pencil 40 has a round or cylindrical configuration. In this case, a smaller tube 42 is employed having an internal diameter slightly smaller than the diameter of the pencil so that the pencil can be inserted into the end of the tube, stretching tube 42 so that the resulting frictional fit forms a secure connection to the pencil. Tube 42 and the pencil are then inserted in the end of tube 24 in the same manner as the carpenter's pencil.

Having described my invention, I claim:

1. A retractable device for retaining a writing instrument to a person's body such that the writing instrument does not drop to the ground if released, comprising:

a flexible member holding device which includes a housing and an elongate flexible member having a first end connected to said housing and a second end which is extendible from and retractable to said housing;

a retaining device connected to said housing for releasibly retaining said housing to the person's body;

a holder connected to said second end of said flexible member for firmly, but releasable attaching the writing instrument to said second end;

the flexible member holding device comprising a reel type retractor, the second end of said flexible member being outwardly extendible from said housing to a desired length upon application of a force sufficient to overcome the rotational bias of said reel, and retractable back to said housing upon the release of said second end;

the holder comprising an elongate holder member having an attachment end and an insertion end, said attachment end being operatively connected to the second end of the flexible member, and said insertion end having an insertion bore into which a portion of the writing instrument is insertable to form a tight frictional engagement between the writing instrument and said holder member; and the attachment end of the holder member being operatively connected to the second end of the flexible member using a ring which extends through a transverse hole through said attachment end, and through a transverse hole of a plug connected to said; second end of said flexible member.

2. The retractable device of claim 1, wherein the insertion bore extends completely longitudinally through the holder member such that said holder member comprises a relatively stiff expandable section of tube, said tube which includes the respective attachment and insertion ends.

3. The retractable device of claim 2, wherein laterally opposite portions of a wall of the tube at the attachment end of said tube are pinched together so as to be more closely disposed, and the hole through the respective wall portions are each reinforced using a respective grommet through which the ring extends.

4. A retractable device for retaining a writing instrument to a person's body such that the writing instrument does not drop to the ground if released, comprising:

a flexible member holding device which includes a housing and an elongate flexible member having a first end connected to said housing and a second end which is extendible from and retractable to said housing;

a retaining device connected to said housing for releasibly retaining said housing to the person's body;

a holder connected to said second end of said flexible member for firmly, but releasibly attaching the writing instrument to said second end;

the flexible member holding device comprising a reel type retractor, the second end of said flexible member being outwardly extendible from said housing to a desired length upon application of a force sufficient to overcome the rotational bias of said retractor, and retractable back to said housing upon the release of said second end;

the holder comprising an elongate holder member having an attachment end and an insertion end, said attachment end being operatively connected to the second end of the flexible member, and said insertion end having an insertion bore into which a portion of the writing instrument is insertable to form a tight frictional engagement between the writing instrument and said holder member; and the insertion bore extending completely longitudinally through the holder member such that said holder member comprises a relatively stiff expandable section of tube, said tube including the respective attachment and insertion ends.

5. The retractable device of claim 4, wherein the attachment end of the holder member is operatively connected to the second end of the flexible member using a ring which extends through a transverse hole through a plug which is affixed within the insertion bore of the tube at the attachment end, and through a transverse hole of a second plug connected to said second end of said flexible member.

6. The retractable device of claim 5, further comprising an adapter which is affixed within the insertion bore at the insertion end of the holder member, said adapter having a smaller insertion bore into which a portion of a smaller writing instrument is insertable to form a tight frictional engagement between the smaller writing instrument and said adapter.

7. The retractable device of claim 6, wherein the smaller insertion bore extends completely longitudinally through the adapter such that said adapter comprises a relatively stiff expandable section of tube.

8. A retractable device for retaining a writing instrument to a person's body such that the writing instrument does not drop to the ground if released, comprising:

a flexible member holding device which includes a housing and an elongate flexible member having a first end connected to said housing and a second end which is extendible from and retractable to said housing;

a retaining device connected to said housing for releasibly retaining said housing to the person's body;

a holder connected to said second end of said flexible member for firmly, but releasibly attaching the writing instrument to said second end;

the holder comprising an elongate holder member having an attachment end and an insertion end, said attachment end being operatively connected to the second end of the flexible member, and said insertion end having an insertion bore into which a portion of the writing instrument is insertable to form a tight frictional engagement between the writing instrument and said holder member; and the attachment end of the holder member being operatively connected to the second end of the flexible member using a ring which extends through a transverse hole through said attachment end, and through a transverse hole of a plug connected to said second end of said flexible member.

9. The retractable device of claim 8, wherein the insertion bore extends completely longitudinally through the holder member such that said holder member comprises a relatively stiff expandable section of tube, said tube which includes the respective attachment and insertion ends.

10. The retractable device of claim 9, wherein laterally opposite portions of a wall of the tube at the attachment end of said tube are pinched together so as to be more closely disposed, and the hole through the respective wall portions are each reinforced using a respective grommet through which the ring extends.

11. The retractable device of claim 8, wherein the insertion bore extends completely longitudinally through the holder member such that said holder member comprises a relatively stiff expandable section of tube, said tube which includes the respective attachment and insertion ends.

12. The retractable device of claim 11, wherein the attachment end of the holder member is operatively connected to the second end of the flexible member using a ring which extends through a transverse hole through a plug which is affixed within the insertion bore of the tube at the attachment end, and through a transverse hole of a second plug connected to said second end of said flexible member.

13. The retractable device of claim 12, further comprising an adapter which is affixed within the insertion bore at the insertion end of the holder member, said adapter having a smaller insertion bore into which a portion of a smaller writing instrument is insertable to form a tight frictional engagement between the smaller writing instrument and said adapter.

14. A retractable device for retaining a writing instrument to a person's body such that the writing instrument does not drop to the ground if released, comprising:

a flexible member holding device which includes a housing and an elongate flexible member having a first end connected to said housing and a second end which is extendible from and retractable to said housing;

a retaining device connected to said housing for releasibly retaining said housing to the person's body;

a holder connected to said second end of said flexible member for firmly, but releasibly attaching the writing instrument to said second end;

the holder comprising an elongate holder member having an attachment end and an insertion end, said attachment end being operatively connected to the second end of the flexible member, and said insertion end having an insertion bore into which a portion of the writing instrument is insertable to form a tight frictional engagement between the writing instrument and said holder member; and the insertion bore extending completely longitudinally through the holder member such that said holder member comprises a relatively stiff expandable section of tube, said tube including the respective attachment and insertion ends.

15. A retractable device for retaining a writing instrument to a person's body such that the writing instrument does not drop to the ground if released, comprising:

a flexible member holding device which includes a housing and an elongate flexible member having a first end connected to said housing and a second end which is extendible from and retractable to said housing;

a retaining device connected to said housing for releasibly retaining said housing to the person's body;

a holder connected to said second end of said flexible member for firmly, but releasibly attaching the writing instrument to said second end;

the holder comprising an elongate holder member having an attachment end and an insertion end, said attachment end being operatively connected to the second end of the flexible member, and said insertion end having an insertion bore into which a portion of the writing instrument is insertable to form a tight frictional engagement between the writing instrument and said holder member;

the attachment end of the holder member being operatively connected to the second end of the flexible member using a ring which extends through a transverse hole through a plug which is affixed within the insertion bore of the tube at the attachment end, and through a transverse hole of a second plug connected to said second end of said flexible member; and an adapter which is affixed within the insertion bore at the insertion end of the holder member, said adapter having a smaller insertion bore into which a portion of a smaller writing instrument is insertable to form a tight frictional engagement between the smaller writing instrument and said adapter.

16. The retractable device of claim 15, wherein the smaller insertion bore extends completely longitudinally through the adapter such that said adapter comprises a relatively stiff expandable section of tube.

* * * * *